US007543449B2

(12) United States Patent
Ivantysynova et al.

(10) Patent No.: US 7,543,449 B2
(45) Date of Patent: Jun. 9, 2009

(54) HYDRAULIC SYSTEM FOR LINEAR DRIVES CONTROLLED BY A DISPLACER ELEMENT

(75) Inventors: Monika Ivantysynova, West Lafayette, IN (US); Robert Rahmfeld, Hamburg (DE); Erik Lautner, Potsdam (DE); Jurgen Weber, Dresden (DE)

(73) Assignee: CNH America LLC, New Holland, PA (US)

( * ) Notice: Subject to any disclaimer, the term of this patent is extended or adjusted under 35 U.S.C. 154(b) by 423 days.

(21) Appl. No.: 10/544,000

(22) PCT Filed: Jan. 14, 2004

(86) PCT No.: PCT/DE2004/000032

§ 371 (c)(1),
(2), (4) Date: May 19, 2006

(87) PCT Pub. No.: WO2004/067969

PCT Pub. Date: Aug. 12, 2004

(65) Prior Publication Data

US 2006/0218913 A1 Oct. 5, 2006

(30) Foreign Application Priority Data

Jan. 29, 2003 (DE) ..... 103 03 360

(51) Int. Cl.
*F16D 31/02* (2006.01)

(52) U.S. Cl. ..... 60/464; 60/476; 91/437

(58) Field of Classification Search ..... 60/464, 60/474–476; 91/437–439
See application file for complete search history.

(56) References Cited

U.S. PATENT DOCUMENTS

| | | | | |
|---|---|---|---|---|
| 4,531,369 | A * | 7/1985 | Izumi et al. | 60/464 |
| 4,707,988 | A * | 11/1987 | Palmers | 60/476 |
| 5,819,574 | A * | 10/1998 | Yogo | 60/476 |

FOREIGN PATENT DOCUMENTS

| | | | |
|---|---|---|---|
| DE | 197 16 081 | C | 8/1998 |
| JP | 60081502 | A | 5/1985 |
| WO | WO 0204820 | A | 1/2002 |

* cited by examiner

*Primary Examiner*—F. Daniel Lopez
(74) *Attorney, Agent, or Firm*—Patrick M. Sheldrake; John William Stader; Michael G. Harms

(57) ABSTRACT

The invention concerns a hydraulic system for linear drives with a differential cylinder, in particular for mobile machines which through the use of displacement-control of the drives avoids the many and diverse disadvantages of the state of the art and renders possible a precise and energy-efficient control of linear drives with differential cylinders, and which is economical and simple to maintain and which can be well integrated into the total hydraulic system of such machines.

13 Claims, 5 Drawing Sheets

HYDRAULIC SYSTEM FOR LINEAR DRIVES CONTROLLED BY A DISPLACER ELEMENT

FIELD OF THE INVENTION

The present invention concerns a hydraulic system for positive-displacement-controlled linear drives, in particular for mobile machines with at least one differential cylinder, at least one high pressure circuit, which comprises at least one pump with variable delivery volume and is connected to a low pressure system by at least two releasable non-return-valves.

BACKGROUND OF THE INVENTION

Current hydraulic systems for mobile machines are based predominantly upon valve-controlled principles. With them the various hydraulic consumers, such as drives for the working hydraulics, steering, braking etc. are controlled by means of hydraulically or electro-hydraulically driven valve arrangements. Usually one or more central pressure supplies are employed for this, frequently in the form of load-sensing pumps, which provide the flows of pressure medium, which through arrangements of one or more valves influence the desired behavior of the hydraulic consumers.

The disadvantage of this valve-controlled hydraulic system is especially the poor utilization of energy. In order to achieve the desired flows of pressure medium at the throttle edges of the valves, pressure differences are necessary, which in principle lead to high energy losses in the hydraulic valve controls. It is not possible to utilize surpluses of energy on a consumer of the system in the form of potential energy or braking energy for other consumers in the system and thereby improve the efficiency of the system, which makes the development of heat in the system worse yet again. A central pressure medium supply possesses in addition the disadvantage that where several consumers must be operated simultaneously, the volume flows are divided, which makes precise control and operation of the individual components more difficult. Safety-relevant circuits, in which it must be ensured that individual consumers, e.g. the steering or brakes, always have sufficient pressure medium available, for example always complicated priority valve arrangements must be implemented.

Simultaneous movement of several consumers in the system leads to a different system behavior in comparison with the individual movements. All of this leads to very complex, and hence expensive and maintenance-intensive valve arrangements, for which their possibilities regarding controllability and utilization of energy are limited.

Occasionally, displacement-controlled systems are used also for rotational drives, in which an adjustable pump that is variable in its displacement volume is used for the control or regulation of the motion of the hydraulic motor(s). The consumer is hence controlled only via the volume flow provided by the pump, without the use of a control valve or similar device in the main circuit. In the transfer of this control principle to linear drives with a differential cylinder, the problem arises that the cylinder volumes on both sides of the cylinder piston are different and hence with the motion differential volume flows occur, which must be compensated for by means of various known solutions.

The previously known displacement controlled systems of this type are extremely inflexible, but possess a large number of additional components or displacement units and do not offer the range of functions and system simplicity that is necessary for use in mobile machines (e.g. DE 40 08 792 A1, DE 27 06 091 A1, CA 605 046, DT 23 49 351 and Rahmfeld and Ivantysynova 2000, Energy-saving controlled linear drive with a differential cylinder, 2. IFK, pp. 191-205, Dresden).

The object of the present invention is therefore to create a hydraulic system for linear drives with a differential cylinder, in particular for mobile machines which through the use of displacement-control of the drives which avoids the many and diverse disadvantages of the state of the art and renders possible a precise and energy-efficient control of linear drives with differential cylinders, and which is economical and simple to maintain and which can be well integrated into the total hydraulic system of such machines. This object of the invention is solved by the characteristics of claim 1.

The non-return-valves are located between the two high-pressure pipes, which lead from the pump with variable delivery volume to the differential cylinder, and the common low-pressure system. If a volume flow is produced by the variable displacement pump and hence the differential cylinder is moved, depending upon the direction of movement of the piston, positive or negative difference volume flows can flow into the low-pressure system or be sucked out of it. In the case of sucking of the volume flow out of the low pressure system, the corresponding non-return valve opens automatically. In the event of the volume flow flowing out of the low-pressure system, the appropriate non-return valve is released by the high pressure of the system.

For the implementation of a floating position, the two sides of the differential cylinder must be connected hydraulically with each other, as a result of which a free movement of the piston is rendered possible. At the same time the non-return-valves are released, so that pressure medium can flow through them in both directions independently of the pump volume flow. The differential volume flow is likewise compensated for in this case by the low-pressure system.

The use of an electronic controller for switching the non-return-valves permits the valves for example to be released on demand by the operator and hence the floating position can be implemented. In addition, it offers the advantage that such a changeover occurs only if certain pressure relationships prevail in the high pressure circuit, so that switching surges or other unwanted conditions are prevented and a supporting of the load existing on the differential cylinder is always prevented. In addition, such a controller permits further functions of such a displacement-controlled circuit, which will be described in more detail below.

Thus it can be envisioned that the control device for regulating the pumps' delivery volume is formed electronically. The delivery volume of the variable flow pumps is usually controlled electro-hydraulically. Therefore it is particularly advantageous if this controller is designed to be integrated together with the control device for the non-return-valves, so that reliable and precise control of the complete circuit behavior is possible. Thus for example, it can be prevented that the pump on the non-return-valves being released delivers a volume flow, which then would briefly be short circuited by the released non-return-valves.

A further embodiment of the hydraulic system envisions that the electronic control device for triggering the check valves possesses an electro-hydraulic 4/2-way valve. By means of such a valve, the releasing connection of the check valve can be connected alternately with one or other side of the high pressure circuit, which corresponds to a changeover between the normal differential volume compensation and the floating position of the differential cylinder. As a result, the position of the non-return-valves is adjusted in accordance with the applied load and hence the pressure relationships within the cylinder. Thus a secure facility to change the operating states is created, as a result of which the risk of pressure surges is minimized.

Alternatively, two electro-hydraulic 3/2-way valves can be employed. A particular embodiment of the hydraulic system envisages that on at least one connection of the differential cylinder a controllable shutoff valve is provided. By means of such a shutoff valve, a connection of the cylinder can be closed off leak-free, which is sensible especially for the implementation of a holding function. At the same time the cylinder is brought to a certain position by the volume flow of the pump and then the high-pressure connection of the differential cylinder is closed off, so that this remains in its position, even if the pump does not maintain the pressure. If on the second connection of the differential cylinder likewise a shutoff valve is provided, the cylinder can be isolated completely from the hydraulic circuit, as a result of which it remains in its position. Through the pump and the connected hydraulic circuit, in this condition a further differential cylinder can be operated, which is likewise isolatable from the circuit by shutoff valves. As a result of this, a further function of the machine can be implemented simply and economically, which can be operated alternatively to the other existing cylinders.

It can be advantageous that the low-pressure system is formed as an accumulator filling circuit with an accumulator-filling valve, a pump with hydraulic reservoir and a pressure-limiting valve. Such an arrangement of the low-pressure side is characterized by a particularly high energy-efficiency. The pump delivers only when the pressure in the low-pressure system falls below a set minimum pressure value. The accumulator filling circuit takes care of maintaining of a low-pressure level between adjustable limits. Such a low-pressure system can be formed centrally for the entire hydraulic system and supply all of the displacement-controlled hydraulic circuits in accordance with the invention.

A further embodiment of the hydraulic system in accordance with the invention is characterized in that the controllable shutoff valve is formed as a seat valve with 3/2-way pilot control. Furthermore it can be sensible, that the controllable shutoff valve is designed as a pneumatic continuous valve. With such a valve, the appropriate blocking function of the connection can be realized simply, without an overly jerky opening and closing of the valve occurring. In this manner undesirable pressure peaks in the system can be prevented.

It could be advantageous that further constantly controllable shutoff valves are provided for alternative and/or simultaneous control of further differential cylinders. As described above, through such valves further functions on the same high-pressure circuit can be implemented, as a result of which these operate always alternatively to each other. The shutoff valves are connected in such a way that the pump with the associated protective and equalization valves is connected to one differential cylinder or several connected together with the same function and supplies these with pressure medium.

A further embodiment of the invention envisages that on the high-pressure circuit connections for a passive oscillation damping system are provided. Such damping systems consist of a hydraulic circuit with a reservoir which reduces the vibrations in the implement that occur for example when running with increased load. For this, the vibration damping system is connected directly to at least one connection on one side of the high-pressure circuit and can be switched on and off, in order to suppress the unwanted vibrations in the desired operating conditions.

In an embodiment of the invention it is envisioned that the electronic control device, which contains the controllable valves and possibly further existing hydraulic system components with the variable displacement pump is formed as an integrated component. Such integration of the pump with a series of valves and the controller offers the advantage of an extremely compact construction, which can be sensible as these components are necessary for each hydraulic function driven by differential cylinder systems. Through this integration, the number of individual components is reduced, the complexity of the overall system is reduced, the cost of installation is lowered, and thus costs of such a system is lowered in comparison with conventional systems.

It can be advantageous for the control and regulation concepts that sensors for recording the system state, in particular, the differential cylinder position and the hydraulic pressures, are provided. Furthermore it can be sensible that an electronic control device for regulating the controllable system components depending upon the measured system state and user settings is envisioned. By measuring the system state and processing the data thus obtained in a control device, the linear cylinder can be operated in a closed control circuit, which significantly improves the precision of positioning and the stability of the system.

The drive system in accordance with the invention can also be controlled, i.e. operated, in an open loop.

Furthermore, the invention is orientated towards a mobile machine with at least one hydraulic system, as described in the foregoing. In an embodiment of such a machine, several high-pressure circuits with a common low-pressure circuit is envisioned. This has, as already explained, the advantage of additional cost savings, as a single low-pressure circuit with a pump and the additional components for supplying all of the hydraulic systems in accordance with the invention suffices.

The invention is explained in more detail below with references to specific figures also provided.

DETAILED DESCRIPTION OF THE EXEMPLARY EMBODIMENTS

Figure 1:
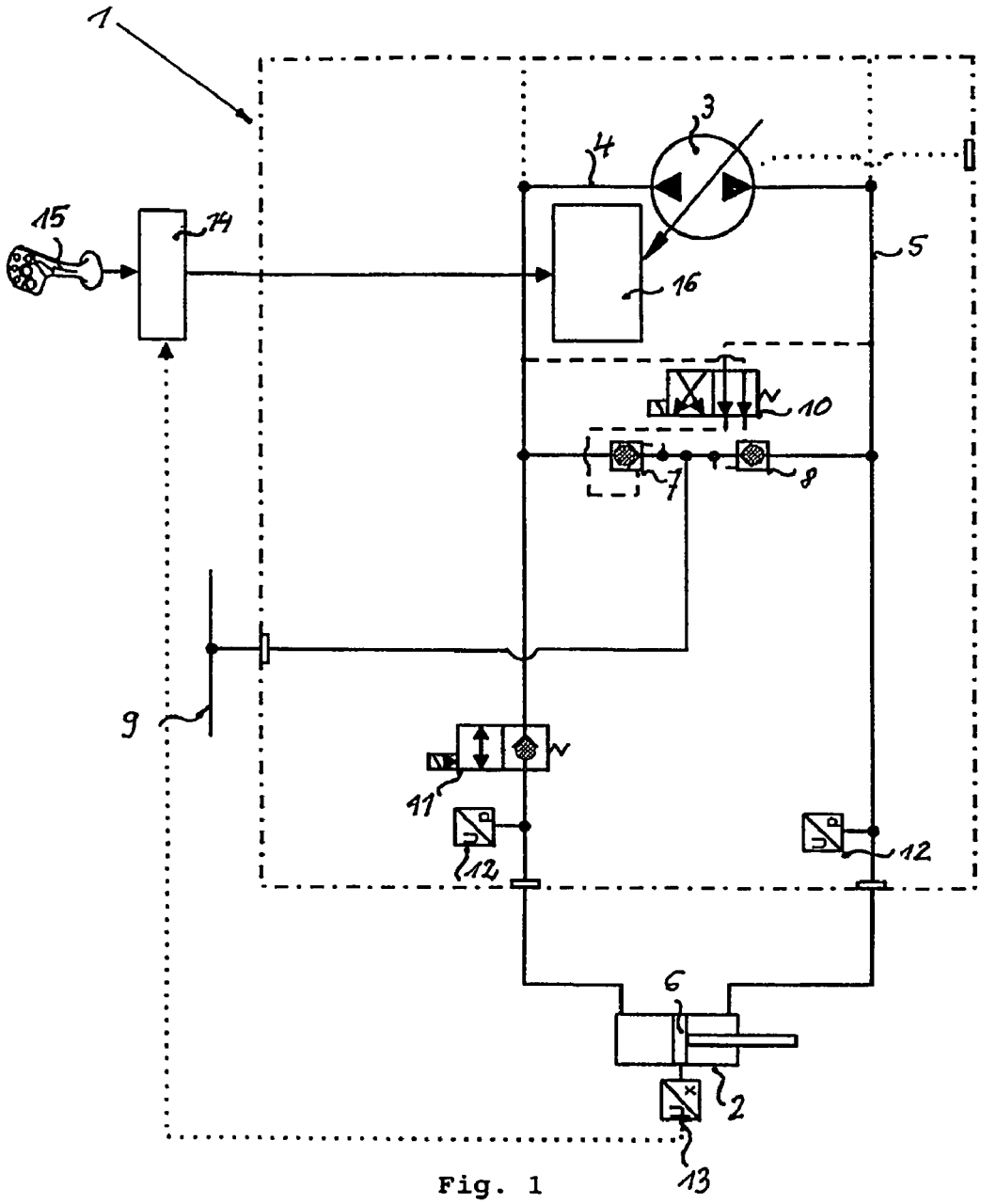
FIG. 1 shows a diagrammatic basic circuit of a hydraulic system in accordance with the present invention.

A hydraulic system generally designated by 1 serves to drive a hydraulic differential cylinder 2. A pump 3 with a variable delivery volume and reversal of the delivery direction is connected via two pipes 4 and 5 to the two connections of the differential cylinder 2. A volume flow delivered by pump 3 in one or the other direction leads to a movement of the piston 6 of the differential cylinder 2. As both chambers of the hydraulic differential cylinder 2 possess a different volume determined by the asymmetric design of the piston 6 and the piston rod, during the movement of the piston 6 a different quantity of pressure medium is given up by one side than is taken up by the other side. In order to reconcile this difference, volume flow in the actual closed circuit between pump 3 and cylinder 2, this high-pressure circuit is connected to the low-pressure system 9 via two releasable non-return valves 7 and 8.

In the stationary case through the higher pressure, in one of the two pipes 4 or 5 the opposite non-return-valve 7 or 8 between the high pressure pipe and the low pressure system is released, so that the low-pressure side of the hydraulic differential cylinder 2 is always connected with the low-pressure system 9. If a volume flow is delivered by the variable pump 3 to the differential cylinder 2, this leads to a movement of the piston 6 of the differential cylinder 2. In doing so the positive or negative difference volume flow dependent upon the direction of motion is equalized with respect to the low-pressure system 9 via one of the two check valves 7 or 8. For this basic setting, an electro-hydraulic 4/2-way valve 10 connected to the check valves 7 and 8 is switched in such a way that the releasing connections of the check valves 7 and 8 are connected respectively with the opposite part of the high-pressure circuit. As a result, even with a change in the loading condition on the differential cylinder 2 a take-up of the difference volume equalization is guaranteed by the other valve without pressure peaks, as the check valves 7 and 8 then switch over precisely if, for example, low pressure is present on both sides of the check valve.

The electronically controllable 4/2-way valve 10 serves also for implementing a floating position function. If valve 10 is changed over (floating position function), the releasing connections of the check valves 7 and 8 are no longer connected with the opposite side but with the side lying in their direction of conduction. As a result, the check valves 7 and 8 open, as soon as a pressure is present in one of the two pipes 4 or 5, which is slightly higher than the low pressure in the low pressure system. Thus the piston 6 can move freely in the differential cylinder 2. Sensibly, on the switching of the 4/2-way valve 10 into the floating position, the pump 3 is set in such a way that it delivers no volume flow, as it would be compensated for by the quasi-short-circuit through check valves 7 and 8.

On one connection of the differential cylinder 2, a controllable shut-off valve 11 is envisioned. With that, this side of the differential cylinder 2 can be shut off leak-free, as a result of which the piston 6 is fixed in this position and a load present on it can be maintained. As a rule, this is the more strongly loaded piston side of the differential cylinder 2.

In the system there are pressure sensors 12, which serve for recording the conditions in the high-pressure pipes. On the hydraulic differential cylinder there is a displacement sensor 13 or an angular sensor in the kinematics of the working equipment, which records the position of the piston. The signals from sensors 12 and 13 are processed by an electronic control device 14 together with the user's wishes set by the operator's controls 15, and from this the appropriate settings are determined, which are then passed on to the electronic controller 16. This then controls the variable pump 3 as regards its displacement volume and hence the delivered volume flow and possibly the switching states of the electronic valves 10 and 11 respectively.

Figure 2:
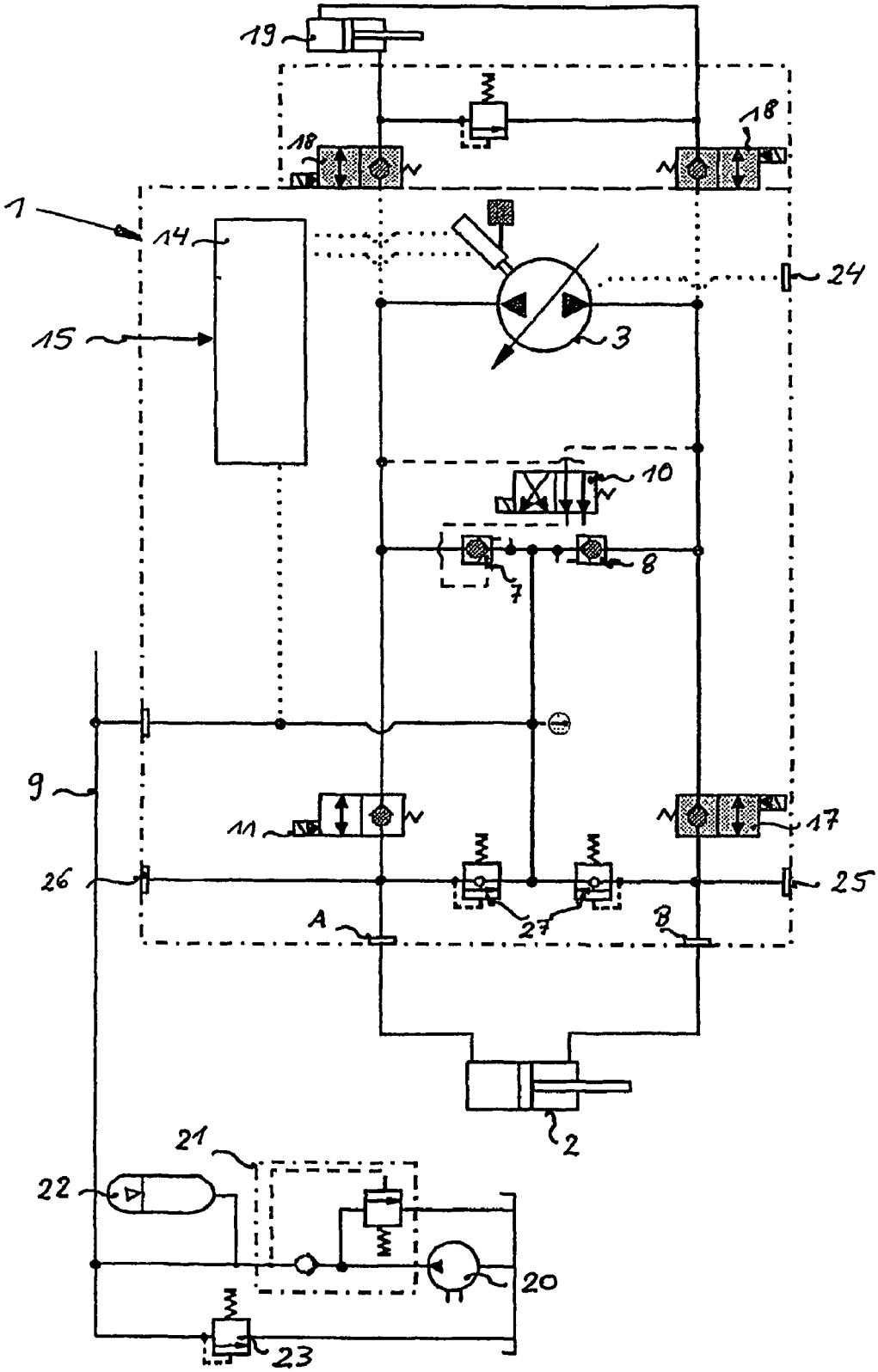
FIG. 2 shows a circuit of a hydraulic system in accordance with the present invention in an expanded version.

An extension of this basic principle is explained in more detail in FIG. 2. Once again, hydraulic differential cylinder 2 is connected essentially directly with a variable pump 3. The differential volume flow is compensated for during delivery by the two releasable non-return valves 7 and 8, the releasing connections of which are connected by an electro-hydraulic 4/2-way valve 10 alternately with the opposite or adjoining sides of the high-pressure circuit. To protect the system from excess pressures, two high-pressure protection devices are envisioned. The integrated electronic control system 14 regulates the driving of the individual components, such as the variable delivery pump 3, taking account of the measured system conditions and the user's settings 15. In addition to the electronically controllable shutoff valve 11, the second side of the differential cylinder 2 is likewise isolatable by an electronically controllable shutoff valve 17. In addition, a further differential cylinder 19 is connected to the high-pressure circuit through two further electronically controllable shutoff valves 18.

In the operation of the second differential cylinder 19, the first differential cylinder 2 is isolated from the hydraulic circuit by the two shutoff valves 11 and 17, and is thereby held in its position. Then the two shutoff valves 18 are opened, so that a volume flow delivered by pump 3 moves the second differential cylinder 19. The differential volumes thus arising are again balanced through the two releasable non-return valves 7 and 8. The controllable shutoff valves 11, 17 and 18 can in some applications also be designed as continuous-valves, so that in special situations these can be driven continuously while in operation, and hence simultaneous operation of both of the differential cylinders 2 and 19 is possible.

The low pressure in the low-pressure system 9 is implemented with an accumulator filling circuit. For this, a fixed displacement pump 20 with an accumulator filling valve 21 and a hydro-pneumatic accumulator 22 is employed. An excess pressure valve 23 protects the system from overloading at the same time the accumulator filling valve 21 ensures that the fixed displacement pump 20 delivers into the low-pressure system only if the pressure falls below a predetermined minimum value. Since the accumulator-filling valve 21 serves purely for maintaining the pressure, the system is energy-efficient to implement.

Other combinations for implementing the low-pressure system 9 are possible, for example, through a simple combination of a fixed displacement pump, accumulator, and pressure-limiting valve or by means of a variable displacement pump. This low pressure is utilized also behind the connection 24 of the variable displacement pump 3, to operate the electro-hydraulic adjusting system for this pump. The connections 25 and 26 serve to connect a passive oscillation damping system to the differential cylinder 2.

Figure 3:
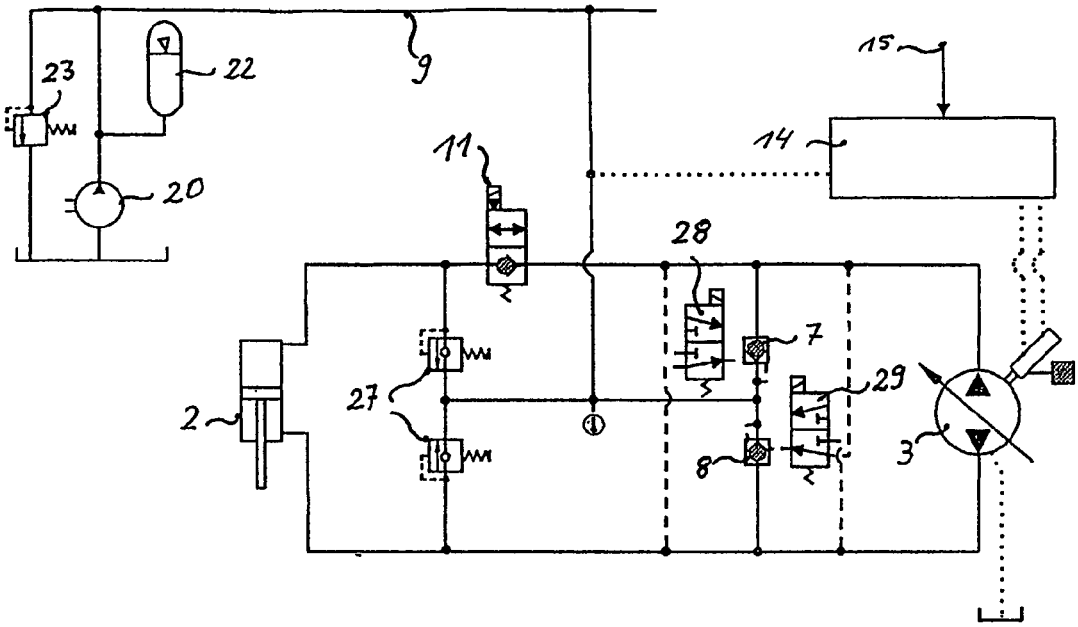
FIG. 3 shows a further embodiment of the present invention.

In FIG. 3, a first variation of the basic principle is depicted, in which instead of the electro-hydraulic 4/2-way valve two 3/2-way valves 28 and 29 are employed, in order to implement the floating position by a reversal of the releasing connections of the pilot controlled non-return-valves 7 and 8. In addition, the low-pressure system is now marked by a fixed displacement pump 20 with a hydropneumatic accumulator 22 and an excess pressure relief valve 23.

Figure 4:
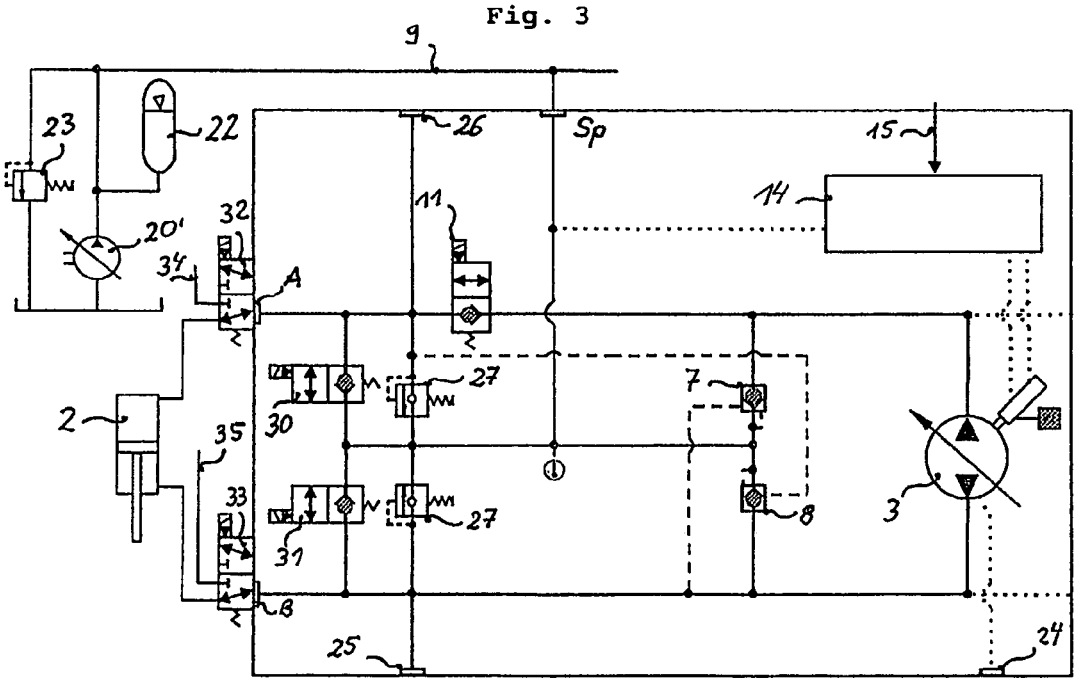
FIG. 4 shows yet another embodiment of the present invention.

In FIG. 4 a further variation of the basic principle is depicted. The floating position is implemented via a bypass through the two valves 30 and 31, i.e. when there is a flow through the valves the two chambers of the cylinder are connected to the low pressure source and the differential cylinder 2 can move freely. The low pressure is impressed here via a variable displacement pump 20' with a hydro-pneumatic accumulator 22 and protected by an excess pressure relief valve 23. In addition, this diagram shows also another possibility, to provide the third function with the pump 3. Two 3/2-way valves 32 and 33 on connections 34 and 35 can on activation change the pump 3 over simply to the third function.

Figure 5:
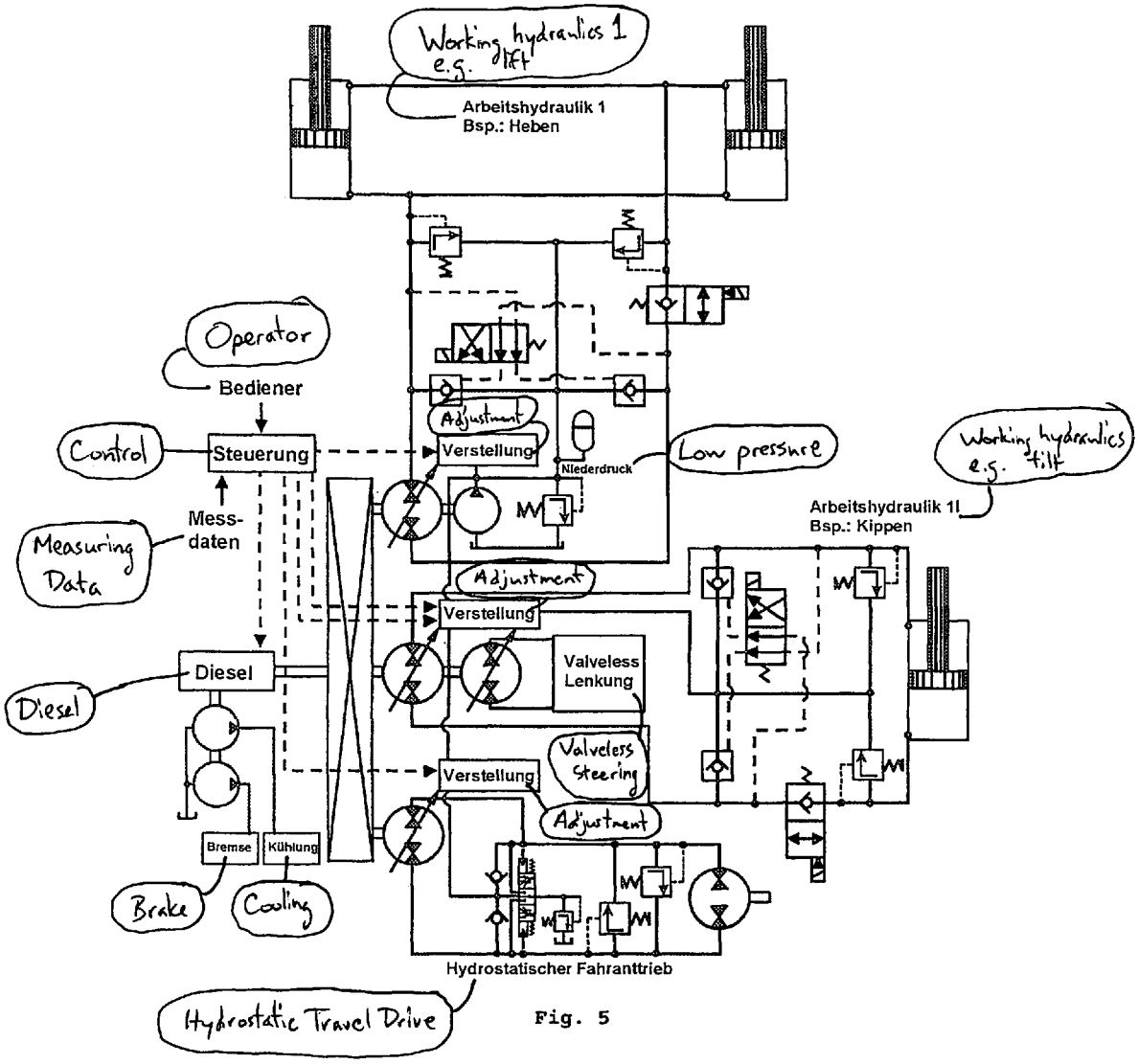
FIG. 5 shows an overall system for a mobile machine.

FIG. 5 shows an overall system for a mobile machine (here a wheeled loader) with displacement controlled working hydraulics in accordance with the previously described displacement-controlled linear drive principle (valveless principle) and a hydrostatic travel drive. The simple coupling of several actuators via the low-pressure system and with the hydrostatic travel drive reduces the cost of the system yet again.

Figure 6:
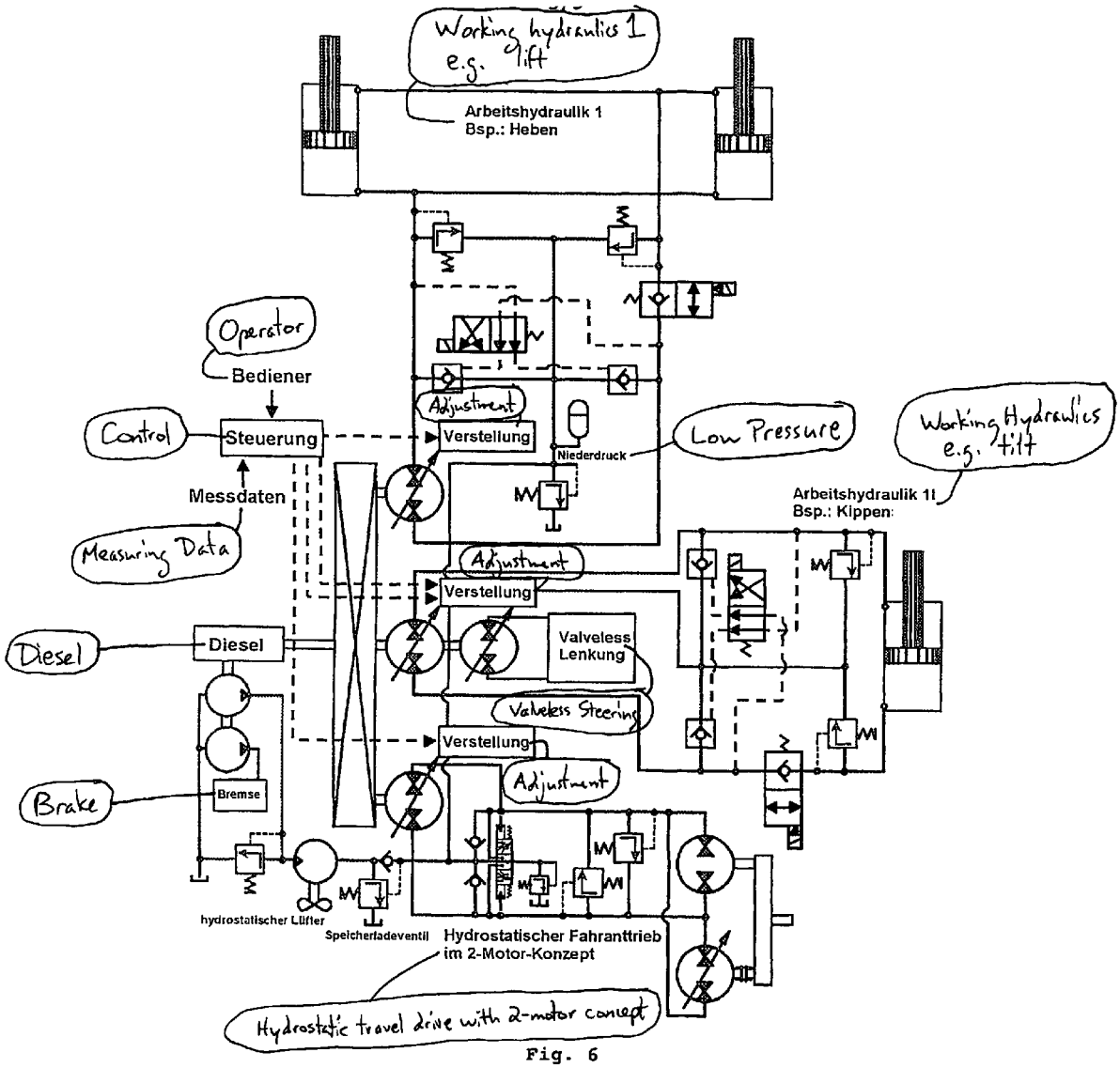
FIG. 6 shows a further overall system for a mobile machine.

In FIG. 6, a further overall system (here a wheeled loader) is depicted, in which a hydrostatic travel drive in the 2-motor concept with an uncoupleable adjusting motor exists and the low pressure is imposed for all of the displacement controlled main functions by the return pipe of the hydrostatic ventilator and an accumulator. An accumulator-filling valve connects the return pipe of the ventilator only if a low-pressure volume flow is required.

Through the electro-hydraulic control of the variable displacement pump 3 all the further functionalities, which are left up to the software, can be implemented, such as for example parallel guidance of the fork, automatic return, switching off at the end of lifting, variable shovel stop, variable cylinder damping (soft-dust), shaking and distribution functions of the shovel for agricultural use etc. The variable displacement pump is addressed directly via the controller of the implement. At the same time the displacement-controlled actuator can be operated subject to position and speed control (example: parallel implement guidance) or also in the open control circuit. The controller in doing so processes as its input signal the wishes of the operator (for example via a joystick).

Naturally the invention is not limited to the foregoing examples, but is modifiable in many respects, without departing from the basic idea. Thus many and diverse designs for the pumps, valves etc, to be employed are conceivable and are sensible, so long as they fulfil the claimed functions. At the same time, separation of the functions of individual valves to several components is conceivable and possibly sensible. Also it is possible to operate further cylinders via shutoff valves on the same high-pressure system.

What is claimed is:

1. A hydraulic system for positive-displacement-controlled linear drives for mobile machines comprising:

a differential cylinder;

a high pressure circuit comprising a pump with variable delivery volume connected to a low pressure system by at least two releasable non-return-valves;

wherein the releasable non-return-valves are connected in such a way with an electronic control device that a changeover between a driving in or out of the differential cylinder remains free from switching surges and a floating position function is possible; in which, for controlling purposes, and a electro-hydraulic 4/2-way valve or two electro-hydraulic 3/2-way valves solely arranged between the high pressure circuit and the non return valves.

2. A hydraulic system in accordance with claim 1, wherein the electronic controller is designed for regulating the pump's, delivery volume and direction of delivery.

3. A hydraulic system in accordance with claim 1, wherein a controllable shutoff valve is utilized on at least one connection on the differential cylinder.

4. A hydraulic system in accordance with claim 3, wherein the controllable shutoff valve is configured to permit continuous driving while in operation.

5. A hydraulic system in accordance with claim 4, wherein an additional continuously controllable valve is configured for the alternative or simultaneous control of an additional differential cylinder.

6. A hydraulic system in accordance with claim 3, wherein the electronic control device, the controllable valve and hydraulic components with the variable displacement pump are designed as an integrated component.

7. A hydraulic system in accordance with claim 1, further comprising high pressure circuit connections configured for connecting to an additional hydraulic circuit with a reservoir for reducing vibrations in the implement.

8. A hydraulic system in accordance with claim 1, further comprising a sensor configured to detect the differential cylinder position or hydraulic pressure.

9. A hydraulic system in accordance with claim 8, wherein an electronic controller for regulating controllable system components in dependence upon measured system states and user inputs is utilized.

10. A mobile machine with at least one hydraulic system in accordance with claim 1.

11. A mobile machine in accordance with claim 10, wherein several high-pressure circuits with a common low-pressure circuit are utilized.

12. A hydraulic system for positive-displacement-controlled linear drives for mobile machines comprising:

a differential cylinder;

a high pressure circuit comprising a pump with variable delivery volume connected to a low pressure system by at least two releasable non-return-valves;

wherein the releasable non-return-valves are connected in such a way with an electronic control device that a changeover between a driving in or out of the differential cylinder remains free from switching surges and a floating position function is possible; in which, for controlling purposes, the non-return-valves are connected with an electro-hydraulic 4/2-way valve or with two electro-hydraulic 3/2-way valves; and wherein the low pressure system is designed as an accumulator filling circuit comprising: an accumulator filling valve; a pump with a hydraulic accumulator; and a pressure limiting valve.

13. A hydraulic system in accordance with claim 12, wherein the accumulator filling valve is configured to permit delivery from the displacement pump into the low-pressure system only if the pressure falls below a predetermined minimum value.

* * * * *